United States Patent [19]

Parker et al.

[11] Patent Number: 4,771,314

[45] Date of Patent: Sep. 13, 1988

[54] DEVELOPER APPARATUS FOR A HIGHLIGHT PRINTING APPARATUS

[75] Inventors: Delmer G. Parker, Irondequoit; William M. Allen, Jr.; Richard P. Germain, both of Webster, all of N.Y.

[73] Assignee: Xerox Corporation, Stamford, Conn.

[21] Appl. No.: 947,321

[22] Filed: Dec. 29, 1986

[51] Int. Cl.[4] ..... G03G 15/00

[52] U.S. Cl. ..... 355/4; 355/3 CH; 430/42

[58] Field of Search ..... 430/31, 42, 902; 355/3 CH, 4

[56] References Cited

U.S. PATENT DOCUMENTS

| | | | |
|---|---|---|---|
| 2,297,691 | 10/1942 | Carlson | 12/7.2 |
| 2,576,047 | 11/1951 | Schaffert | 101/216 |
| 2,647,464 | 8/1953 | Ebert | 427/144 |
| 2,825,814 | 3/1958 | Walkup | 430/48 |
| 3,013,890 | 12/1961 | Bixby | 430/45 |
| 3,045,644 | 7/1962 | Schwertz | 118/645 |
| 3,816,115 | 6/1974 | Gundlach et al. | 430/54 |
| 3,832,170 | 8/1974 | Nagamatsu et al. | 430/46 |
| 3,838,919 | 10/1974 | Takahashi | 355/4 |
| 4,068,938 | 1/1978 | Robertson | 355/4 |
| 4,078,929 | 3/1978 | Gundlach | 430/42 |
| 4,346,982 | 8/1982 | Nakajima et al. | 355/3 |
| 4,403,848 | 9/1983 | Snelling | 355/4 |
| 4,496,232 | 1/1985 | Guzik | 355/3 CH |
| 4,540,272 | 9/1985 | Abe et al. | 355/4 |
| 4,562,129 | 12/1985 | Tanaka et al. | 430/42 |
| 4,562,130 | 12/1985 | Oka | 430/54 |
| 4,647,181 | 3/1987 | Kohyama et al. | 430/42 X |

*Primary Examiner*—Patrick R. Salce
*Assistant Examiner*—Kristine Peckman

[57] ABSTRACT

Printing apparatus for forming toner images in black and at least one highlighting color in a single pass of a change retentive imaging surface through the processing areas, including a development station, of the printing apparatus. The development station includes a pair of developer housings each of which has supported therein a pair of magnetic brush development rolls which are electrically biased to provide electrostatic development and cleaning fields between the charge retentive surface and the developer rolls. The rolls are biased such that the development fields between the first rolls in each housing and the charge retentive surface are greater than those between the charge retentive surface and the second rolls and such that the cleaning fields between the second rolls in each housing and the charge retentive surface are greater than those between the charge retentive surface and the first rolls.

21 Claims, 2 Drawing Sheets

DEVELOPER APPARATUS FOR A HIGHLIGHT PRINTING APPARATUS

BACKGROUND OF THE INVENTION

This invention relates generally to the rendering of latent electrostatic images visible using multiple colors of dry toner or developer and more particularly to a developer apparatus for forming toner images in black and at least one highlighting color in a single pass of the imaging surface through the processing areas of a printing apparatus.

The invention can be utilized in the art of xerography or in the printing arts. In the practice of xerography, it is the general procedure to form an electrostatic latent image on a xerographic surface by first uniformly charging a photoconductive insulating surface or photoreceptor. The charge is selectively dissipated in accordance with a pattern of activating radiation corresponding to original images. The selective dissipation of the charge leaves a latent charge pattern on the imaging surface corresponding to the areas not struck by radiation.

This charge pattern is made visible by developing it with a toner. The toner is generally a colored powder which adheres to the charge pattern by electrostatic attraction.

The developed image is sometimes then fixed to the imaging surface or is transferred to a receiving sheet to which it is fixed.

This method of forming and developing charge patterns is set forth in greater detail in U.S. Pat. No. 2,297,691 to C. F. Carlson. Still other means of forming and developing electrostatic images are set forth in U.S. Pat. No. 2,647,464 to J. P. Ebert; U.S. Pat. No. 2,576,047 to R. M. Schaffert and U.S. Pat. No. 2,825,814 to L. E. Walkup.

Modern business and computer needs oftentimes make it advantageous and desirable to reproduce originals which contain two or more colors. It is sometimes desirable that a copy or reproduction also contain two colors.

An accounting report having certain information highlighted in a second color is one example of a type of document which would desirably be copied in more than one color. Computer generated cathode ray tube (CRT) displays are another example in which it is sometimes desirable to reproduce an image in more than one color. For instance, it is sometimes desirable that those portions of the CRT display image representing permanent forms are reproduced in a first color and those portions of the image representing variable information are reproduced in a second color.

Several useful methods are known for making copies having plural colors. Some of these methods make high quality images, however, there is still need for improvement. In particular, it is desirable to be able to produce low-smear images in a single pass of the photoreceptor or other charge retentive surface past the printing process areas or stations.

One method of producing images in plural (i.e. two colors, black and one highlight color) is disclosed in U.S. Pat. No. 3,013,890 to W. E. Bixby in which a charge pattern of either a positive or negative polarity is developed by a single, two-colored developer. The developer of Bixby comprises a single carrier which supports both triboelectrically relatively positive and relatively negative toner. The positive toner is a first color and the negative toner is of a second color. The method of Bixby develops positively charged image areas with the negative toner and develops negatively charged image areas with the positive toner. A two-color image occurs only when the charge pattern includes both positive and negative polarities.

Plural color development of charge patterns can be created by the Tesi technique. This is disclosed by F. A. Schwertz in U.S. Pat. No. 3,045,644. Like Bixby, Schwertz develops charge patterns which are of both a positive and negative polarity. Schwertz's development system is a set of magnetic brushes, one of which applies relatively positive toner of a first color to the negatively charged areas of the charge pattern and the other of which applies relatively negative toner to the positively charged areas.

Methods and apparatus for making colored xerographic images using colored filters and multiple development and transfer steps are disclosed, respectively, in U.S. Pat. Nos. 3,832,170 to K. Nagamatsu et al and 3,838,919 to T. Takahashi.

U.S. Pat. No. 3,816,115 to R. W. Gundlach and L. F. Bean discloses a method for forming a charge pattern having charged areas of a higher and lower strength of the same polarity. The charge pattern is produced by repetitively charging and imagewise exposing an overcoated xerographic plate to form a composite charge pattern. Development of the charge pattern in one color is disclosed.

A method of two-color development of a charge pattern, preferably with a liquid developer, is disclosed in the commonly assigned U.S. Pat. No. 4,068,938 issued on Jan. 17, 1978. This method requires that the charge pattern for attracting a developer of one color be above a first threshold voltage and that the charge pattern for attracting the developer of the second color be below a second threshold voltage. The second threshold voltage is below the first threshold voltage. Both the first and second charge patterns have a higher voltage than does the background.

As disclosed in U.S. Pat. No. 4,403,848, a multi-color printer uses an additive color process to provide either partial or full color copies. Multiple scanning beams, each modulated in accordance with distinct color image signals, are scanned across the printer's photoreceptor at relatively widely separated points, there being buffer means provided to control timing of the different color image signals to assure registration of the color images with one another. Each color image is developed prior to scanning of the photoreceptor by the next succeeding beam. Following developing of the last color image, the composite color image is transferred to a copy sheet. In an alternate embodiment, an input section for scanning color originals is provided. The color image signals output by the input section may then be used by the printing section to make full color copies of the original.

In U.S. Pat. No. 4,562,129 there is disclosed an image forming method comprising the steps of forming a latent electrostatic image having at least three different potential levels on a photosensitive member, and developing the latent electrostatic image with a developer to obtain a monochromatic or dichromatic copy image, the developer being composed of at least two components of a nonmagnetic insulating toner and a high-resistivity magnetic carrier triboelectrically chargeable with the toner and having a high resistivity of at least $10^{12}$ ohm-cm, the carrier being in the form of particles about 5 to about 40 microns in size, prepared by dispersing a magnetic fine powder in an insulating resin and containing the magnetic fine powder in a proportion of 50 to 75% by weight.

U.S. Pat. No. 4,562,130 relates to a composite image forming method having the following features: (A) Forming a composite latent electrostatic image of potentials at three different levels by two image exposures, the potential of the background area (nonimage area) resulting from the first image exposure is corrected to a stable intermediate potential which is constant at all times by charging the area with scorotron charging means. Accordingly, the image can be developed to a satisfactory copy image free from fog. (B) The composite latent electrostatic image is developed by a single developing device collectively, or by two developing devices. In the latter case, the composite latent image is not developed after it has been formed, but the latent image resulting from the first exposure is developed first before the second exposure, and the latent image resulting from the second exposure is thereafter developed, whereby the fog due to an edging effect is prevented whereby there is produced a satisfactory copy image.

In U.S. Pat. No. 4,346.982, there is disclosed an electrophotographic recording device having means for uniformly charging the surface of a light-sensitive recording medium, means for forming latent images on said light-sensitive recording medium and means for developing said latent images into visual images, said electrophotographic recording device being characterized in that said means for forming latent images on said light-sensitive recording medium comprises a plurality of exposing means for exposing a positive optical image and a negative optical image in such a manner that the light receiving region of said negative optical image overlaps the light receiving region of said positive optical image, whereby a latent image is formed on the surface of said light-sensitive recording medium consisting of a first area which does not receive any light of said negative or positive image and holds an original potential, a second area which receives the light of only said positive image and holds a reduced potential from that of said original potential and a third area which receives the light of both of said negative image and said positive image and holds a further reduced potential than said reduced potential of said second area.

In U.S. Pat. No. 4,078,929, R. Gundlach teaches the use of tri-level xerography as a means to achieve single-pass highlight color copy. In this scheme the photoreceptor, initially charged to voltage $V_0$, is discharged to approximately $V_0/2$ imagewise in the background (white) image areas, and to near zero or residual potential in the highlight color (color other than black) portions of the image. The unexposed portions of the photoreceptor now correspond to the parts of the image that are to be printed black. It should be noted that whether the charged area is developed black or color in practice depends on the choice of developer polarity as described below.

The charge pattern in the U.S. Pat. No. 4,078,929 is developed with toner particles of first and second color. The toner particles of one of the colors is positively charged and the toner particles of the other color are negatively charged. In one embodiment, the toner particles are supplied by a developer which comprises a mixture of triboelectrically relatively positive and relatively negative carrier beads. The carrier beads support, respectively, the relatively negative and relatively positive toner particles. Such a developer is generally supplied to the charge pattern by cascading it across the imaging surface supporting the charge pattern. In another embodiment, the toner particles are presented to the charge pattern by a pair of magnetic brushes. Each brush supplies a toner of one color and one charge. In yet another embodiment, the development system is biased to about the background voltage. Such biasing results in a developed image of improved color sharpness.

FIG. 1A illustrates the tri-level electrostatic latent image in more detail. Here $V_0$ is the initial charge level, $V_{ddp}$ the dark discharge potential (unexposed), $V_w$ the white discharge level and $V_c$ the photoconductor residual potential (full exposure).

Color discrimination in the development of the electrostatic latent image is achieved by passing the photoreceptor sequentially through two developer housings. The housings are electrically biased to voltages which are offset from the background voltage $V_w$, the direction of offset depending on the toner in the housing. One housing (for the sake of illustration, the first) contains developer with black toner having triboelectric properties such that the toner is driven to the highest charged ($V_{ddp}$) areas of the latent image by the electric field between the photoreceptor and the development rolls biased at $V_{bb}$ (V black bias) as shown in FIG. 1B. Conversely, the triboelectric charge on the colored toner in the second housing is chosen so that the toner is urged towards parts of the latent image at residual potential by the electric field existing between the photoreceptor and the development rolls in the second housing at bias voltage $V_{cb}$ (V color bias).

Because the composite image developed on the photoreceptor consists of both positive and negative toner, a pre-transfer corona charging step is necessary to condition the toner to enable effective transfer to a substrate using corona discharge.

In tri-level xerography, the entire photoreceptor voltage difference ($|V_{ddp}-V_c|$, as shown in FIG. 1A) must be shared between the charged area development (CAD) and the discharged area development (DAD). This corresponds to $\approx$600 volts (if a realistic value for a photoreceptor $V_{ddp}$ of 700 volts and a residual discharge voltage of 100 volts are assumed). Allowing an additional 100 volts for the cleaning field in each development housing ($|V_{bb}-V_{white}|$ or $|V_{white-Vcb}|$) means an actual development contrast voltage for CAD of $\approx$200 volts and an $\approx$equal amount for DAD. Although 200 volts contrast is generally sufficient to develop to saturation using CMB (Conductive Magnetic Brush) development, 250 volts is more desirable in practice to assure adequate system latitude as the developers age. While it might appear that this additional development contrast could be obtained by simply charging the photoreceptor to a higher $V_o$, this approach has the undesirable effect of increasing the reverse bias voltage stress on the first developer ($|V_{bb}-V_c|$) thereby tending to create wrong sign toner by induction charging which is deposited in the complementary parts of the latent image. Thus, charging the photoreceptor to a higher $V_o$ is an unacceptable solution.

Another problem encountered in tri-level xerography is the apparent smearing of the image developed by the first housing as it passes through the second development station. Because this "smearing" is most prominent at the trail edges of the first image, it is easy to assume that this undesirable effect is caused by the second housing's magnetic brush spicules physically "raking" the first image. However, we have demonstrated that the real cause is re-development of spurious first image toner picked up by the second development housing magnetic brush and driven to the white area immediately after the first image by the development field, $V_w - V_{cb}$. That this is so can be shown by operating the second development station at a bias voltage, $V_{cb}$ equal to $V_w$. In this case, the background is excessive but the trail edge of the first image is not smeared.

BRIEF SUMMARY OF THE INVENTION

To obtain an improved development performance in tri-level xerography, we have provided a development system capable of producing different development and cleaning fields which result in improved image formation. To this end, at least two developer housings, each including at least two magnetic brush developer rolls are provided. The first roller in each housing is electrically biased to a voltage level which enhances image development of one of the two colored images while precluding development of the other colored image with the toner contained in that housing. Thus, the bias on the first roller in each housing is offset toward the white voltage level by $\approx$50 to 60 volts. This increases the magnitude of the development field (while diminishing the cleaning field) as a means for promoting higher developed densities. Furthermore, by reducing the the cleaning field on the lead roll in the first housing, the reverse field stress is smaller at the first roll and the amount of development of the other image areas with wrong sign toner created by induction is less.

In the second development housing, the smaller cleaning fields also lessen the tendency to redevelop spurious toner scavenged from a first image along it's trail edge and thereby promote better image quality as well as affording better BCO (bead carryout control). The bias on the development roller next following the first developer roller of each development station is set above or below the white voltage level by $\approx$100 volts (as the case may be) to obtain a cleaning field that scavenges spuriously deposited background toner and provides adequate background suppression.

DETAILED DESCRIPTION OF THE PREFERRED EMBODIMENTS OF THE INVENTION

For a general understanding of the features of the present invention, a description thereof will be made with references to the drawings.

Figure 1A:
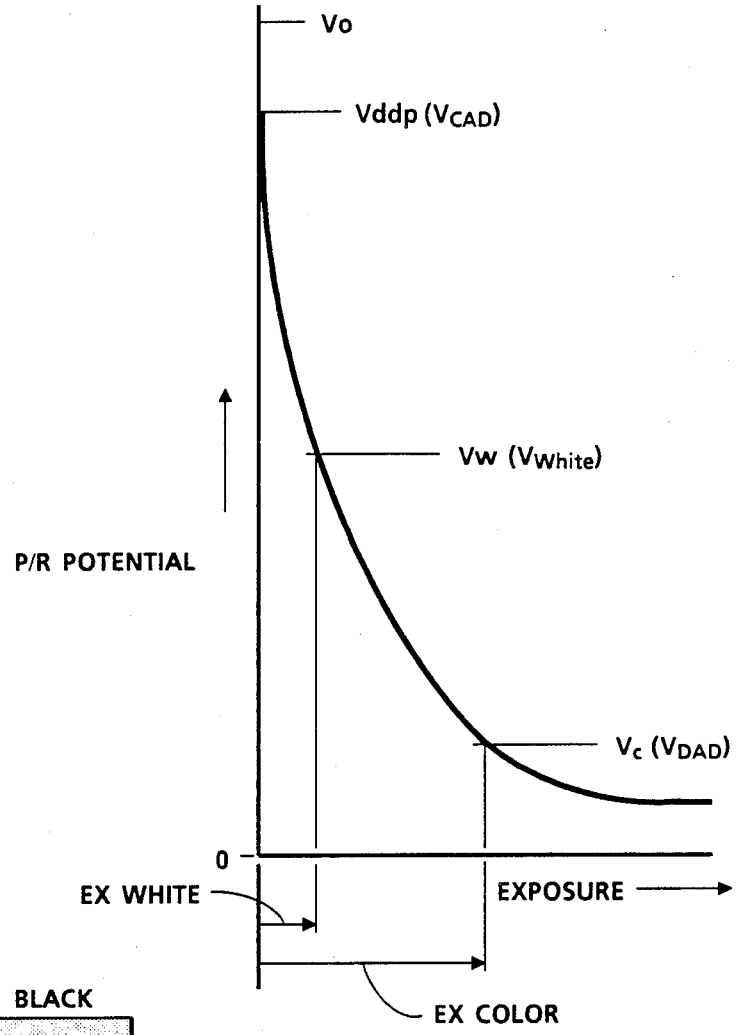
FIG. 1A is a plot of photoreceptor potential versus exposure for a tri-level image.
Figure 1B:
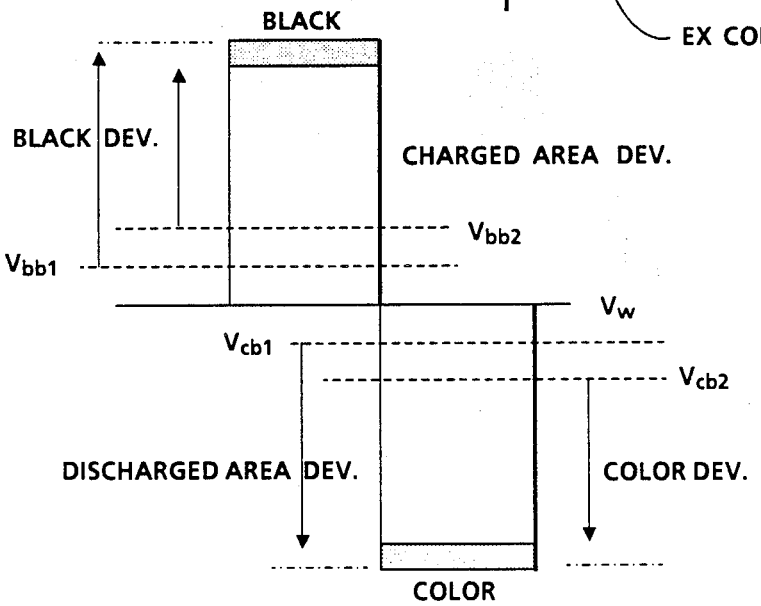
FIG. 1B is a plot of photoreceptor potential illustrating single-pass, highlight color latent image characteristics.
Figure 2:
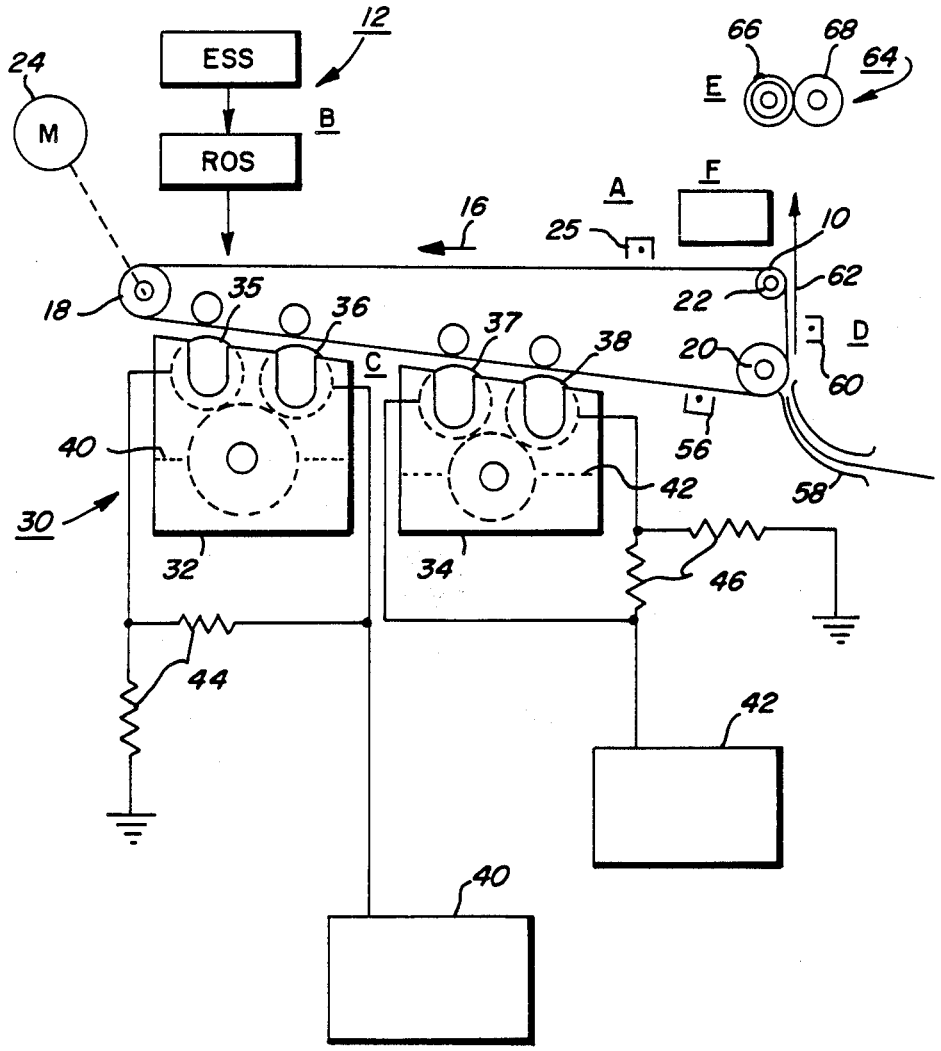
FIG. 2 is schematic illustration of a printing apparatus incorporating the inventive features of our invention.

FIG. 2 schematically depicts the various components of an illustrative electrophotographic printing machine incorporating the present invention. In as much as the art of electrophotographic printing is well known, the various processing stations employed in the printing machine illustrated in FIG. 1 will be described only briefly.

As shown in FIG. 2, the printing machine utilizes a photoconductive belt 10 which consists of a photoconductive surface and an electrically conductive substrate. Belt 10 moves in the direction of arrow 16 to advance successive portions thereof sequentially through the various processing stations disposed about the path of movement thereof. Belt 10 is entrained about a plurality of rollers 18, 20 and 22, the former of which can be used as a drive roller and the latter of which can be used to provide suitable tensioning of the photoreceptor belt 10. Motor 24 rotates roller 18 to advance belt 10 in the direction of arrow 16. Roller 18 is coupled to motor 24 by suitable means such as a belt drive.

As can be seen by further reference to FIG. 2, initially a portion of belt 10 passes through charging station A. At charging station A, a corona discharge device such as a scorotron or corotron indicated generally by the reference numeral 25, charges the belt 10 to a selectively high uniform positive or negative potential, $V_0$. Preferably charging is negative.

Next, the charged portion of the photoreceptor surface is advanced through exposure station B. At exposure station B, The uniformly charged photoreceptor or charge retentive surface 10 is exposed to a laser based input and/or output scanning device 12 which causes the charge retentive surface to be discharged in accordance with the output from the scanning device. Preferably the scanning device is a three level Raster Output Scanning device.

The photoreceptor which is initially charged to a voltage $V_0$, undergoes dark decay to a level $V_{ddp}$. When exposed at the exposure station B it is discharged to $V_w$ imagewise in the background (white) image areas and to $V_c$ which is near zero or ground potential in the highlight (i.e. color other than black) color parts of the image. See FIG. 1A.

At development station C, a magnetic brush development system, indicated generally by the reference numeral 30 advances developer materials into contact with the electrostatic latent images. The development system 30 comprises first and second developer housings 32 and 34. Preferably, each magnetic brush development housing includes a pair of magnetic brush developer rollers. Thus, the housing 32 contains a pair of rollers 35, 36 while the housing 34 contains a pair of magnetic brush rollers 37, 38. Each pair of rollers 36, 38 advances its respective developer material into contact with the latent image. Each developer roller pair forms brush structure comprising toner particles which are attracted by the latent images on the photoreceptor.

Color discrimination in the development of the electrostatic latent image is achieved by passing the photoreceptor past the two developer housings in a single pass with the magnetic brush rolls electrically biased to voltages which are offset from the background voltage $V_w$, the direction of offset depending on the toner in the housing. One housing e.g. 32 (for the sake of illustration, the first) contains developer with black toner 40 having triboelectric properties such that the toner is driven to the most highly charged ($V_{ddp}$) areas of the latent image by the electrostatic field (development field) between the photoreceptor and the development rolls biased at $V_{bb1}$ and $V_{bb2}$ (V black biases) as shown in FIG. 1B. Conversely, the triboelectric charge on colored toner 42 in the second housing is chosen so that the toner is urged towards parts of the latent image at residual potential, $V_c$ by the electrostatic field (development field) existing between the photoreceptor and the development rolls in the second housing at bias voltages $V_{cb1}$ and $V_{cb2}$ (V color biases.)

In prior art tri-level xerography, the entire photoreceptor voltage difference ($|V_{ddp}-V_c|$, as shown in FIG. 1A) is shared equally between the charged area development (CAD) and the discharged area development (DAD). This corresponds to $\approx$600 volts (if a realistic photoreceptor value for $V_{ddp}$ of 700 volts and a residual discharge voltage of 100 volts are assumed). Allowing an additional 100 volts for the cleaning field in each development housing ($|V_{bb}-V_{white}|$ or $|V_{white-Vcb}|$) means an actual development contrast voltage for CAD of $\approx$200 volts and an $\approx$equal amount for DAD. In the foregoing case the 200 volts of contrast voltage is provided by electrically biasing the first developer housing to a voltage level of approximately 500 volts and the second developer housing to a voltage level of 300 volts. Although 200 volts contrast is generally sufficient, 250 volts is more desirable in practice to assure adequate system latitude as the developers age.

According to our invention, we provide more desirable development field with the first developer housing by biasing the roller 35 to a voltage level ($V_{bb1}$) equal to 450 volts which provides 250 ($|V_{ddp}-V_{bb1}|$) or (700−450=250) volts for the development field. An added advantage of this increased development field is that the reverse development field is reduced by the magnitude of such increase, therefore, there is less tendency for induction charging to reverse the polarity of the charge on the black toner and cause it to be attracted to the red latent image. The reverse development field is that field which is established between the developer rollers and the colored image areas. The bias on the roller 36 in the first housing is 500 volts, consequently, the increased development seen with the roller 35 is not present with the roller 36. However, the cleaning field ($|V_{bb2}-V_w|$) is twice that of the field established between roller 35 and the photoreceptor in the $V_w$ areas. The bias, $V_{cb1}$ on the roller 37 is 350 volts thereby providing 250 volts for the development field between the roller 37 and the colored image areas of the photoreceptor. The bias, $V_{cb2}$ on the roller 38 is 300 volts thereby providing only a 200 volt development field but a larger cleaning as in the case of the roller 36.

The foregoing developer biases are provided by power supplies 40 and 42. These power supplies are each provided with suitable resistor pairs 44 and 46 for providing the different biases to the rolls 35, 36, 37 and 38.

Because the composite image developed on the photoreceptor consists of both positive and negative toner, a pre-transfer corona discharge member 56 is provided to condition the toner for effective transfer to a substrate using corona discharge.

A sheet of support material 58 is moved into contact with the toner image at transfer station D. The sheet of support material is advanced to transfer station D by conventional sheet feeding apparatus, not shown. Preferably, sheet feeding apparatus includes a feed roll contacting the uppermost sheet of a stack copy sheets. Feed rolls rotate so as to advance the uppermost sheet from stack into a chute which directs the advancing sheet of support material into contact with photoconductive surface of belt 10 in a timed sequence so that the toner powder image developed thereon contacts the advancing sheet of support material at transfer station D.

Transfer station D includes a corona generating device 60 which sprays ions of a suitable polarity onto the backside of sheet 58. This attracts the charged toner powder images from the belt 10 to sheet 58. After transfer, the sheet continues to move, in the direction of arrow 62, onto a conveyor (not shown) which advances the sheet to fusing station E.

Fusing station E includes a fuser assembly, indicated generally by the reference numeral 64, which permanently affixes the transferred powder image to sheet 58. Preferably, fuser assembly 64 comprises a heated fuser roller 66 and a back-up roller 68. Sheet 58 passes between fuser roller 66 and back-up roller 68 with the toner powder image contacting fuser roller 66. In this manner, the toner powder image is permanently affixed to sheet 58. After fusing, a chute, not shown, guides the advancing sheet 58 to a catch tray, also not shown, for subsequent removal from the printing machine by the operator.

After the sheet of support material is separated from photoconductive surface of belt 10, the residual toner particles carried by the non-image areas on the P/r are removed therefrom. These particles are removed from photoconductive surface at cleaning station F.

Subsequent to cleaning, a discharge lamp (not shown) floods the photoconductive surface with light to dissipate any residual electrostatic charge remaining prior to the charging thereof for the successive imaging cycle.

What is claimed is:

1. Printing apparatus for forming images on a charge retentive surface, said apparatus comprising:

means for forming at least a tri-level latent electrostatic image on said charge retentive surface, said latent electrostatic image comprising image areas at different charge levels;

means for applying toner to one of said image areas to thereby render said one of said image areas visible;

means for applying a first electrical bias to said toner applying means to thereby establish development and cleaning fields between it and said charge retentive surface;

means for applying a second electrical bias to said toner applying means to thereby establish development and cleaning fields between it and said charge retentive surface, said electrical biases comprising different magnitudes.

2. Apparatus according to claim 1 wherein said first electrical bias is less than said second electrical bias whereby a greater development field is established between said charge retentive surface and said toner applying means when said first electrical bias is applied and a greater cleaning field is established between said charge retentive surface and toner applying means when said second electrical bias is applied.

3. Apparatus according to claim 2 wherein said one of said image areas is first exposed to the field created by said first electrical bias.

4. Apparatus according to claim 3 wherein said toner applying means comprises a first developer housing containing toner applying structure.

5. Apparatus according to claim 4 including a second developer housing containing toner applying structure for rendering the other of said image areas visible.

6. Apparatus according to claim 5 wherein each of said toner applying structures comprises a pair of magnetic brush members.

7. Apparatus according to claim 6 wherein said magnetic brush members comprise at least two magnetic brush rolls in each of said developer housings.

8. Apparatus according to claim 7 wherein said first electrical bias is applied to one of the magnetic brush rolls in said first developer housing and said second electrical bias is applied to the other of the brush rolls in said first developer housing.

9. Apparatus according to claim 8 including means for applying electrical third and fourth biases to the magnetic brush rolls in said second developer housing.

10. Apparatus according to claim 9 wherein said toner image is formed in a single pass of said charge retentive surface past said developer housings.

11. Apparatus according to claim 10 wherein said tri-level latent electrostatic image comprises image areas at approximately 100 and 700 volts and background areas at approximately 400 volts.

12. Apparatus according to claim 11 wherein said first, second, third and fourth electrical biases are 450, 500, 350 and 300 volts, respectively.

13. Apparatus according to claim 1 wherein there the difference between said first and second bias voltages is in the range of 50 to 60 volts.

14. Apparatus according to claim 13 wherein said first electrical bias is less than said second electrical bias whereby a greater development field is established between said charge retentive surface and said toner applying means when said first electrical bias is applied and a greater cleaning field is established between said charge retentive surface and toner applying means when said second electrical bias is applied.

15. Apparatus according to claim 14 wherein said latent image is first exposed to the fields created by said first bias.

16. Apparatus according to claim 15 including a second developer housing containing toner applying structure.

17. Apparatus according to claim 16 wherein each of said toner applying structures comprises a pair of magnetic brush members.

18. Apparatus according to claim 17 wherein said magnetic brush members comprise at least two magnetic brush rolls in each of said developer housings.

19. Apparatus according to claim 18 wherein said first electrical bias is applied to only one of the brush rolls in said first developer housing and said second electrical bias is applied to the other of the brush rolls in said first developer housing.

20. Apparatus according to claim 19 wherein said toner image is formed in a single pass of said charge retentive surface past said developer housings.

21. Apparatus according to claim 20 wherein said tri-level latent electrostatic image comprises image areas at approximately 100 and 700 volts and background areas at approximately 400 volts.

* * * * *